US005950042A

United States Patent [19]

Goto et al.

[11] Patent Number: 5,950,042

[45] Date of Patent: Sep. 7, 1999

[54] IMAGE FORMING APPARATUS AND METHOD OF CONTROLLING THE SAME

[75] Inventors: Hiroshi Goto, Itami; Yoichi Fujieda, Nishinomiya; Ryuji Inoue, Itami; Shuichi Nakagawa, Suita, all of Japan

[73] Assignee: Minolta Co., Ltd., Osaka, Japan

[21] Appl. No.: 09/111,027

[22] Filed: Jul. 7, 1998

[30] Foreign Application Priority Data

Jul. 8, 1997 [JP] Japan ..... 9-182784

[51] Int. Cl.[6] ..... G03G 15/00; G03G 15/06

[52] U.S. Cl. ..... 399/53; 358/298; 358/406; 358/504; 399/49

[58] Field of Search ..... 399/49, 38, 46, 399/53, 55; 358/406, 504, 296, 298; 430/120

[56] References Cited

U.S. PATENT DOCUMENTS 4,890,121 12/1989 Hirahara et al. ..... 358/296 X 5,742,325 4/1998 Curry et al. ..... 358/298 X 5,835,235 11/1998 Goto et al. ..... 358/406

*Primary Examiner*—William Royer

*Assistant Examiner*—Sophia S. Chen

*Attorney, Agent, or Firm*—Sidley & Austin

[57] ABSTRACT

An image forming apparatus for making tone reproductions using a variable area toning method. In addition to an image carrying member, on which a latent image is formed, and a developer, to develop a formed latent image, the apparatus is characterized by having a subsystem to form a plurality of first latent images having different dot area indexes, a subsystem to form a plurality of second latent images having different resolutions, first and second detector systems to respectively detect the image characteristics of the first and second latent images, and first and second correction subsystems to correct development conditions in accordance with respective outputs from the first and second detector systems.

19 Claims, 8 Drawing Sheets

IMAGE FORMING APPARATUS AND METHOD OF CONTROLLING THE SAME

BACKGROUND OF THE INVENTION

This application is based on application Ser. No. 182784/1997 filed in Japan, the contents of which is hereby incorporated by reference.

1. Field of the invention

The present invention relates generally to an image forming apparatus such as a copying machine or a printer for developing an electrostatic latent image formed on an image carrying member by a developing device and a method of controlling the same, and more particularly, to an image forming apparatus so adapted as to make tone reproduction by a variable area toning method and a method of controlling the same.

2. Description of the Related Art

Conventionally known as an image forming apparatus such as a copying machine or a printer is an image forming apparatus utilizing, in reproducing the tone of a formed image, a tone production method by density of each element (hereinafter "variable area toning method") for forming a pixel having a plurality of dots and supplying a developer to one or more dots at a predetermined position in the pixel to reproduce a tone.

In the image forming apparatus utilizing such a variable area toning method, developing conditions are set such that the image density of a formed image (an output image density) increases under predetermined conditions as the ratio of dots, to which a developer is supplied, in a pixel (a dot area index) increases, as indicated by a solid line in FIG. 1.

In the image forming apparatus utilizing such a variable area toning method, however, tone characteristics change depending on changes in its operating environment. For example, when the image forming apparatus is used under a low temperature and low humidity environment or under a high temperature or high humidity environment, the change in the output image density with the increase in the dot area index differs from that indicated by the above-mentioned solid line, as shown in FIG. 1. That is, the output image density is lower than a desired density under the low temperature and low humidity environment, while being higher than the desired density under the high temperature and high humidity environment. In either case, when an image having a dot area index of approximately 50% is formed, the output image density greatly changes.

The higher the resolution of the image is, the more sensitive the change in the output image density based on the changes in the operating environment appears.

Therefore, the applicant of the present invention has disclosed a method of adjusting, in the case of a dot area index of approximately 50% at which an output image density generally changes based on changes in operating environment, developing conditions using a detection pattern having a high resolution which is greatly affected by the changes in the environment and a reference pattern having a low resolution which is hardly affected by the changes in the environment such that the density of an output image formed using the detection pattern is approximately the same as the density of an output image formed using the reference pattern, and preventing tone characteristics from changing depending on the changes in the operating environment, in the previous U.S. patent application Ser. No. 08/534,252, now U.S. Pat. No. 5,835,235.

Even when the tone characteristics are thus prevented from changing depending on the changes in the operating environment, there occurs a case where the output image density does not increase under predetermined conditions with the increase in the dot area index, so that good tone characteristics are not obtained.

For example, in a developing device for conveying a developer to a developing area opposite to an image carrying member by a developer carrying member and developing an electrostatic latent image formed in the image carrying member, consider a case where the developer carrying member and the image carrying member in the developing device are provided so as to be opposite to each other with predetermined spacing (a developing gap) interposed therebetween. In this case, when the developing gap varies, a point of inflection occurs in the change in output image density with the change in dot area index. That is, when the developing gap decreases, the output image density is lower than a predetermined value at a low dot area index, while being higher than a predetermined value at a high dot area index, as shown in FIG. 2. Conversely, when the developing gap increases, the output image density is higher than a predetermined value at a low dot area index, while being lower than a predetermined value at a high dot area index.

In any case, the output image density at a dot area index of approximately 50% is a value almost corresponding to a predetermined value. In the method disclosed in the previous application, therefore, the changes in the tone characteristics cannot be suitably corrected, so that good tone reproduction cannot be accomplished.

Consider a case where the developer carrying member is provided so as to be brought into contact with the image carrying member in the above-mentioned developing device. In this case, as the beam diameter of a laser beam used for forming the electrostatic latent image in the image carrying member changes, the tone characteristics in the image forming apparatus change. For example, even if such control is carried out that the output image density increases under predetermined conditions as the dot area index increases in a case where image formation is carried out using a laser beam having a beam diameter of 50 $\mu$m, a point of inflection occurs in the change in output image density with the change in dot area index when the beam diameter of the laser beam becomes 65 $\mu$m. That is, although the output image density at a dot area index of 50% becomes a value almost corresponding to a predetermined value, the output image density is lower than a predetermined value at a low dot area index, while being higher than a predetermined value at a high dot area index, as shown in FIG. 3.

Also in this case, therefore, the changes in the tone characteristics cannot be suitably corrected, so that good tone reproduction cannot be accomplished in the method disclosed in the previous application, as in the above-mentioned case.

SUMMARY OF THE INVENTION

An object of the present invention is to solve various problems, as described above, in an image forming apparatus for making reproduction by a tone variable area toning method.

Another object of the present invention is to make it possible to stably accomplish tone reproduction by suitably correcting changes in tone characteristics in an image forming apparatus for developing an electrostatic latent image formed in an image carrying member using a developing device in which a developer carrying member for holding a developer is provided with required spacing from the image carrying member even if the spacing between the developer carrying member and the image carrying member varies.

Still another object of the present invention is to make it possible to stably accomplish good tone reproduction by suitably correcting changes in tone characteristics in an image forming apparatus for developing an electrostatic latent image formed in an image carrying member using a developing device in which a developer carrying member for holding a developer is provided so as to be brought into contact with an image carrying member even if the beam diameter of a laser beam used for forming the electrostatic latent image in the image carrying member varies.

In the present invention, in an image forming apparatus for making reproduction using a tone variable area toning method, there are provided an image carrying member on which a latent image is formed, developing means for developing the latent image on the image carrying member, first latent image forming means for forming a plurality of latent images having different dot area indexes on the image carrying member, first detecting means for detecting the image densities of images obtained by developing the latent images formed by the first latent image forming means, first correcting means for correcting developing conditions in the developing means depending on the image densities detected by the first detecting means, second latent image forming means for forming a plurality of latent images having different resolutions on the image carrying member, second detecting means for detecting the image densities of images obtained by developing the latent images formed by the second latent image forming means, and second correcting means for correcting the developing conditions in the developing means depending on the image densities detected by the second detecting means.

In the image forming apparatus according to the present invention, first determining means determines whether or not there is a point of inflection in the relationship between the dot area index and the corresponding image density detected by the first detecting means, and the first correcting means corrects the developing conditions in the developing means when there is a point of inflection.

Furthermore, second determining means determines whether or not the difference between the image densities detected in the second detecting means is larger than a predetermined value, and the second correcting means corrects the developing conditions in the developing means when the density difference is larger than the predetermined value.

Consider a case where the developer carrying member for holding the developer is provided with required spacing from the image carrying member in the developing means. In this case, when an AC voltage on which a DC voltage is superimposed is exerted between the developer carrying member and the image carrying member, to develop the electrostatic latent image formed in the image carrying member, at least one of the frequency and the amplitude value of the AC voltage is changed in adjusting the developing conditions by the first correcting means, while at least one of the duty ratio of the AC voltage and the value of the DC voltage is changed in adjusting the developing conditions by the second correcting means.

On the other hand, consider a case where the developer carrying member for holding the developer is provided so as to be brought into contact with the image carrying member in the developing means. In this case, when an AC voltage on which a DC voltage is superimposed is exerted between the developer carrying member and the image carrying member, to develop the electrostatic latent image formed in the image carrying member, the amplitude value of the AC voltage is changed in adjusting the developing conditions by the first correcting means, while the value of the DC voltage is changed in adjusting the developing conditions by the second correcting means.

In the image forming apparatus according to the present invention, the input images which differ in dot area index are first developed, to determine whether or not there is a point of inflection in the change in the density of each of output images obtained by the development (hereinafter referred to as output image density) by the first determining means. When the first determining means determines that there is a point of inflection, the developing conditions are adjusted by the first correcting means such that the point of inflection does not exist. Thereafter, input images which are the same in dot area index and differ in resolution are developed, to determine whether or not the difference between the densities of output images obtained by the development is larger than a predetermined value by the second determining means. When the second determining means determines that the density difference is larger than the predetermined value, the developing conditions are adjusted by the second correcting means such that the difference between the densities of the output images decreases. The above-mentioned operations are repeatedly performed until the point of inflection is not detected, and the density difference decreases below the predetermined value.

The developing conditions are thus adjusted. Consider a case where the developer carrying member is provided with required spacing from the image carrying member. In this case, even if a point of inflection occurs in the change in the output image density with the change in the dot area index due to the variation in the spacing, the point of inflection is detected by the first determining means, and the developing conditions are adjusted by the first correcting means on the basis of the determination, so that the point of inflection does not exist.

On the other hand, consider a case where the developer carrying member is provided so as to be brought into contact with the image carrying member. In this case, even if a point of inflection occurs in the change in the output image density with the change in the dot area index due to the variation in the beam diameter of a laser beam used for forming the electrostatic latent image in the image carrying member, the point of inflection is detected by the first determining means, and the developing conditions are adjusted by the first correcting means on the basis of the determination, so that the point of inflection does not exist.

When the developing conditions are adjusted such that the point of inflection does not exist, after which the input images which are the same in dot area index and differ in resolution are developed, to find the difference between the densities of the output images. When the density difference is larger than a predetermined value, the density difference is detected by the second determining means, and the developing conditions are adjusted by the second correcting means on the basis of the determination, so that the difference between the densities of the output images decreases below the predetermined value, and the increase in the output image density with the increase in the dot area index satisfies predetermined conditions.

A point of inflection may, in some cases, occur in the change in the output image density with the change in the dot area index as a result of adjusting the developing conditions by the second correcting means. When the above-mentioned operations are repeatedly performed until the point of inflection is not detected, and the density difference decreases below the predetermined value, however, the changes in the tone characteristics in the image forming apparatus are finally suitably corrected, so that good tone reproduction can be stably accomplished.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Image forming apparatuses according to preferred embodiments of the present invention and a method of controlling the same will be specifically described on the basis of the accompanying drawings.

(Embodiment 1)

Figure 4:
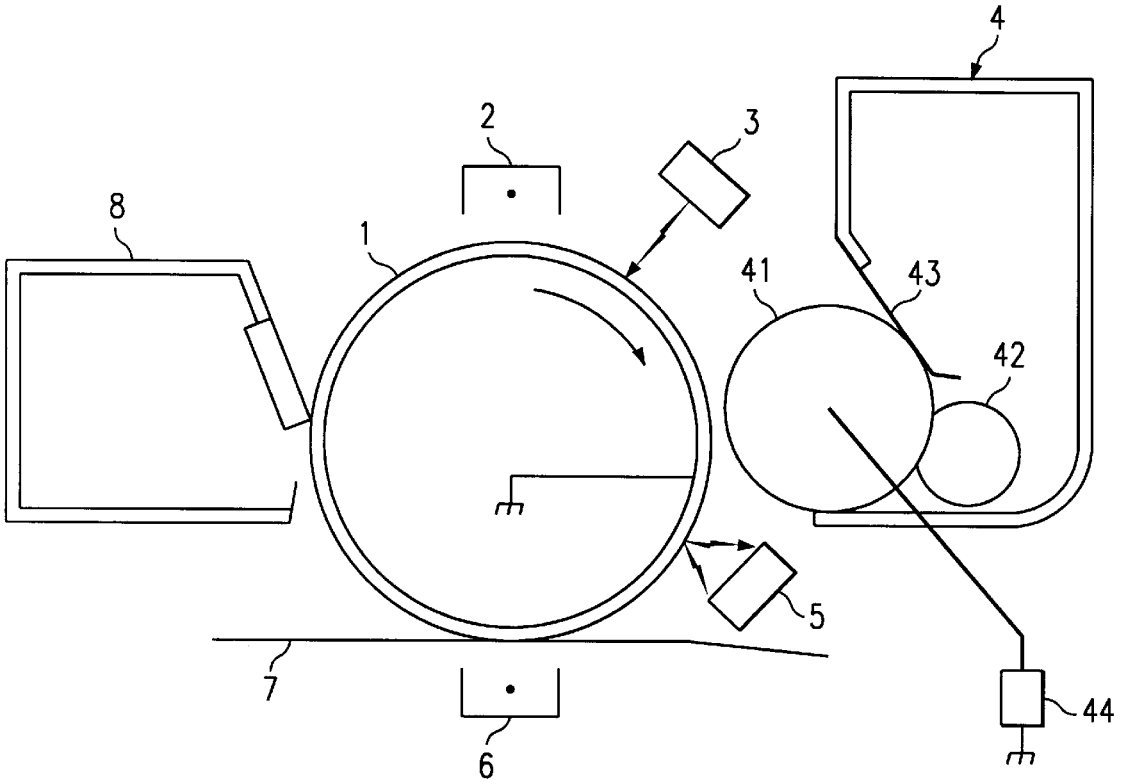
FIG. 4 is a schematic cross-sectional view of an image forming apparatus according to a first embodiment of the present invention.

In an image forming apparatus according to the present embodiment 1, provided around an image carrying member 1 in a drum shape are a charger 2 for charging the surface of the image carrying member 1 to have a predetermined surface potential, a laser light source 3 for irradiating the surface of the image carrying member 1 at the predetermined surface potential with light based on an input image to form an electrostatic latent image, a developing device 4 for supplying a developer (toner) to the surface of the image carrying member 1 to develop the electrostatic latent image formed as described above, an optical density sensor 5 for optically detecting the density of a toner image formed on the surface of the image carrying member 1, a transfer charger 6 for transferring the toner image formed on the surface of the image carrying member 1 on a paper sheet 7, and a cleaning device 8 for removing the toner remaining on the surface of the image carrying member 1 after the transfer, as shown in FIG. 4.

In the image forming apparatus, the image carrying member 1 in a drum shape is rotated, and the surface of the image carrying member 1 is charged to have a predetermined surface potential by the charger 2, after which the surface of the image carrying member 1 is irradiated with light based on an input image from the laser light source 3 to form an electrostatic latent image. Toner is then fed to the electrostatic latent image thus formed on the surface of the image carrying member 1 from the developing device 4 to develop the electrostatic latent image, thereby forming a toner image corresponding to the electrostatic latent image on the surface of the image carrying member 1.

In the image forming apparatus, in developing the electrostatic latent image formed on the surface of the image carrying member 1 by the developing device 4 as described above, a developer carrying member 41 in a roller shape is provided so as to be opposite to the image carrying member 1 with a predetermined developing gap interposed therebetween.

The developer carrying member 41 is rotated, and the toner in the developing device is fed to the surface of the developer carrying member 41 by a feed roller 42, the toner is conveyed toward the image carrying member 1 with the toner held on the surface of the developer carrying member 41, and a regulating member 43 is brought into contact with the surface of the developer carrying member 41 to regulate the amount of the toner conveyed by the developer carrying member 41. Thereafter, the toner thus regulated is conveyed to a developing area opposite to the image carrying member 1 by the developer carrying member 41, and an AC voltage on which a DC voltage is superimposed is exerted as a developing bias voltage on the developer carrying member 41 from a power supply 44 to perform development, thereby forming a toner image corresponding to the electrostatic latent image on the surface of the image carrying member 1.

After the toner image is thus formed on the surface of the image carrying member 1, the toner image is introduced into a position opposite to the transfer charger 6 by the rotation of the image carrying member 1, to transfer the toner image formed on the surface of the image carrying member 1 on the paper sheet 7 by the transfer charger 6. The paper sheet 7 is introduced into a fixing device (not shown), to fix the transferred toner image on the paper sheet 7. On the other hand, the toner remaining on the surface of the image carrying member 1 after the transfer is removed by the cleaning device 8.

In the image forming apparatus according to the present embodiment, developing conditions in the developing device 4 are suitably controlled before image formation is carried out in the above-mentioned manner.

Figure 5:
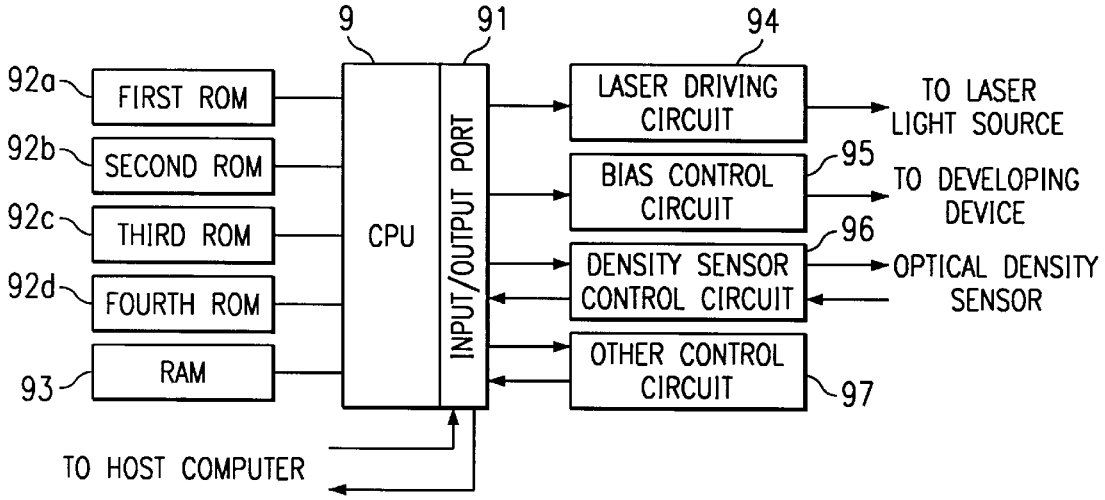
FIG. 5 is a block diagram showing the structure of a control section in the image forming apparatus according to the first embodiment.

In thus suitably controlling the developing conditions in the developing device 4, in the image forming apparatus according to the present embodiment, a control section is constructed as shown in a block diagram of FIG. 5.

The control section in the image forming apparatus is centered around a CPU 9 comprising an input/output port 91, as shown in FIG. 5. Connected to the CPU 9 are a first ROM 92*a* storing a program relating to sequence control, a second ROM 92*b* storing tone reproduction data used at the time of printing, a third ROM 92*c* storing data used in adjusting the developing conditions, that is, dot area index data which are the same in resolution and differ in dot area index as well as resolution data which are the same in dot area index and differ in resolution, a fourth ROM 92*d* storing the frequency and the amplitude value of an AC voltage, the duty ratio and the value of a DC voltage which are previously changed in adjusting the developing conditions, and a RAM 93 for storing various data and the like.

On the other hand, connected to the input/output port 91 are a laser driving circuit 94 for driving the laser light source 3, a bias control circuit 95 for adjusting the power supply 44 for applying a developing bias voltage to the developer carrying member 41 in the developing device 4, a density sensor control circuit 96 for controlling a detecting operation of the optical density sensor 5, and another control circuit 97 for controlling other driving sections such as a driving motor (not shown) for rotating the image carrying member 1, sensors, and the like. The CPU 9 receives information from a host computer (not shown) through the input/output port 91, and further outputs information to the host computer. Examples of the information received from the host computer include image data to be printed and control data such as a printing command.

Figure 6:
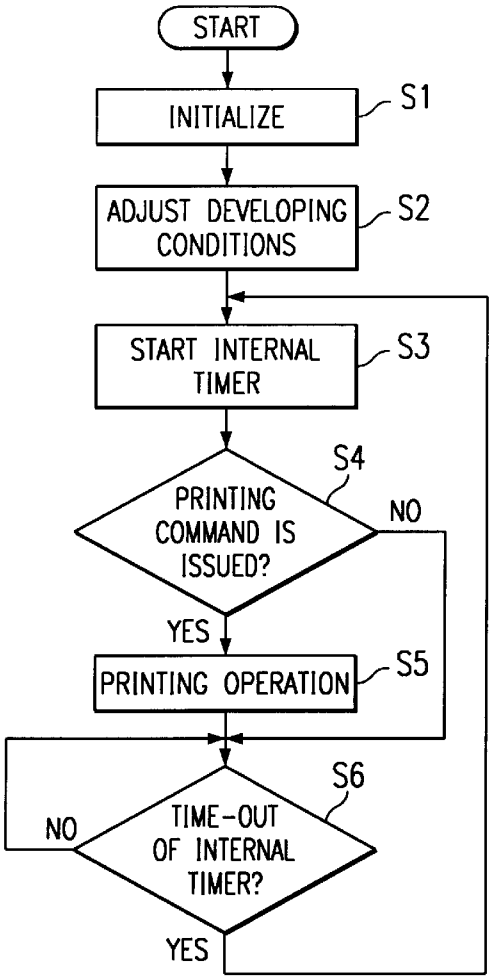
FIG. 6 is a diagram showing a main routine for control relating to an image forming operation performed by a CPU in the image forming apparatus according to the first embodiment.

In forming an image in the image forming apparatus according to the present embodiment, a main routine for control relating to an image forming operation performed by the CPU 9 will be described on the basis of a flow chart shown in FIG. 6.

When the image forming apparatus is first started upon turning on the power, the contents of the first ROM 92*a*, the second ROM 92*b* and the third ROM 92*c* are checked as initialization, various flags are initialized, and the initial values of developing conditions such as a developing bias voltage are set in the step S1.

Figure 7:
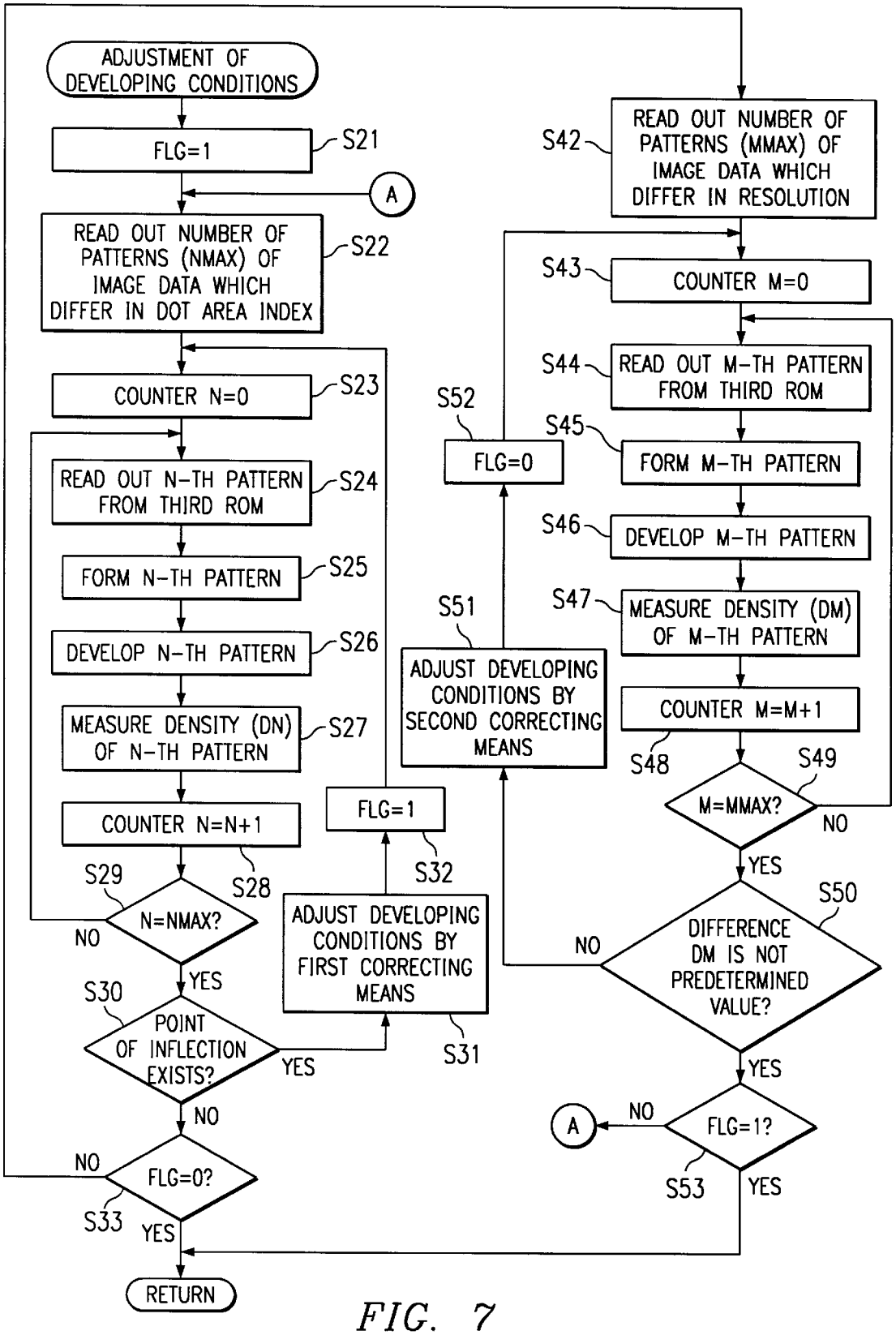
FIG. 7 is a diagram showing a subroutine for adjusting developing conditions in the image forming apparatus according to the first embodiment.

In the step S2, the developing conditions such as a developing bias voltage are adjusted in accordance with a subroutine for adjusting developing conditions shown in FIG. 7. The subroutine for adjusting developing conditions will be described later.

In the step S3, an internal timer for defining time required for an image forming operation is started. In the subsequent step S4, it is judged whether or not a printing command is issued from the host computer.

When the printing command is issued, a printing operation is performed in the step S5, and the program is then returned to the step S3 upon waiting for the time-out of the internal timer in the step S6. A subroutine for a printing operation will be described later. On the other hand, when the printing command is not issued in the foregoing step S4, the step S5 is skipped, and the program is returned to the step S3 upon waiting for the time-out of the internal timer.

Description is now made of a subroutine for adjusting developing conditions shown in FIG. 7.

Consider a case where input images which differ in dot area index are developed as described above. In this case, in determining whether or not there is a point of inflection in the change in the density of each of the output images obtained by the development (hereinafter referred to as output image density), dot area index data, which are the same in resolution and differ in dot area index, stored in the third ROM 92*c* are used as the input images. On the other hand, consider a case where input images which are the same in dot area index and differ in resolution. In this case, in determining whether or not the difference between the densities of output images obtained by the development is larger than a predetermined value, resolution data, which are the same in dot area index and differ in resolution, stored in the third ROM 92*c* are used as the input images.

In the subroutine for adjusting developing conditions, a flag for holding information relating to the adjustment of developing conditions is initialized to "1" in the step S21, and the number of patterns Nmax of image data in the dot area index data stored in the third ROM 92*c* is then read out in the step S22.

A counter N is then set to zero in the step S23, image data with the N-th pattern corresponding to the counter N is read out from the third ROM 92*c* in the step S24, and the image data with the N-th pattern read out is exposed to the image carrying member 1 by the laser light source 3 to form an electrostatic latent image corresponding to the image data with the N-th pattern in the step S25.

The electrostatic latent image with the N-th pattern formed in the image carrying member 1 is developed in the subsequent step S26, and an image density $D_N$ of an image with the N-th pattern obtained by thus developing the electrostatic latent image formed in the image carrying member 1 is measured by the optical density sensor 5 in the step S27. After the image density $D_N$ of the image with the N-th pattern is thus measured by the optical density sensor 5, the image with the N-th pattern is removed by the cleaning device 8 without being transferred on the paper sheet 7.

The value of the counter N is then incremented by one in the step S28, and it is judged in the step S29 whether or not the value of the counter N after the increment reaches the number of patterns Nmax. When the value of the counter N does not reach the number of patterns Nmax, the program is returned to the foregoing step S24. A routine in the foregoing steps S24 to S29 is repeated until the value of the counter N reaches the number of patterns Nmax.

When the value of the counter N reaches the number of patterns Nmax, the program proceeds to the subsequent step S30. In the step S30, it is judged whether or not there is a point of inflection in output characteristics representing the change in output image density.

Figure 8:
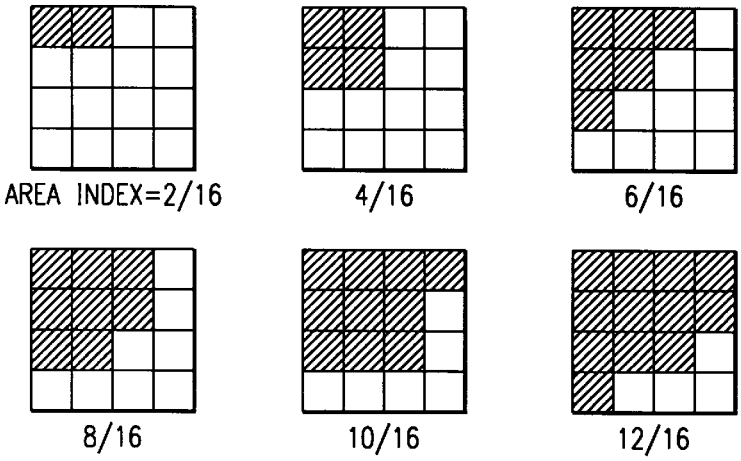
FIG. 8 is a diagram showing image data, which are the same in resolution and differ in dot area index, used for judging whether or not there is a point of inflection in output characteristics in the image forming apparatus according to the first embodiment.

In the image forming apparatus according to the present embodiment, examples of image data in the dot area index data include image data respectively having dot area indexes, in a case where four dots by four dots are used as one pixel, of 2/16, 4/16, 6/16, 8/16, 10/16, and 12/16, as shown in FIG. 8. These data correspond to a resolution of 150 lines in a case where tone reproduction is made using four dots by four dots as one pixel in a printer having a resolution of 600 DPI, for example.

Consider a case where it is judged whether or not there is a point of inflection in the output characteristics in the foregoing step S30. Based on an image density $D_N$, measured by the optical density sensor 5, of an image obtained by developing the image data having each of the above-mentioned dot area indexes, difference data representing the change in the image density $D_N$ with the increase in the dot area index is found. When the change of the difference data thus found is changed from increase to decrease or is changed from decrease to increase, as shown in Table 1 and Table 2, it is judged that a point of inflection exists in the output characteristics. On the other hand, when the change of the difference data is monotonous increase or monotonous decrease, as shown in Table 3 and Table 4, it is judged that there is no point of inflection in the output characteristics.

TABLE 1

| | dot area index | | | | | |
|---|---|---|---|---|---|---|
| | 2/16 | 4/16 | 6/16 | 8/16 | 10/16 | 12/16 |
| $D_N$ | 0.15 | 0.42 | 0.78 | 1.20 | 1.40 | 1.50 |
| difference data | 0.019 | 0.034 | 0.045 | 0.053 | 0.025 | 0.013 |

TABLE 1-continued

| | dot area index | | | | | |
|---|---|---|---|---|---|---|
| | 2/16 | 4/16 | 6/16 | 8/16 | 10/16 | 12/16 |
| change | increase | increase | increase | increase | decrease | decrease |

TABLE 2

| | dot area index | | | | | |
|---|---|---|---|---|---|---|
| | 2/16 | 4/16 | 6/16 | 8/16 | 10/16 | 12/16 |
| $D_N$ | 0.28 | 0.55 | 0.70 | 0.87 | 1.10 | 1.50 |
| difference data | 0.035 | 0.034 | 0.019 | 0.021 | 0.029 | 0.050 |
| change | decrease | decrease | decrease | increase | increase | increase |

TABLE 3

| | dot area index | | | | | |
|---|---|---|---|---|---|---|
| | 2/16 | 4/16 | 6/16 | 8/16 | 10/16 | 12/16 |
| $D_N$ | 0.10 | 0.25 | 0.45 | 0.70 | 1.05 | 1.50 |
| difference data | 0.013 | 0.019 | 0.025 | 0.031 | 0.044 | 0.056 |
| change | increase | increase | increase | increase | increase | increase |

TABLE 4

| | dot area index | | | | | |
|---|---|---|---|---|---|---|
| | 2/16 | 4/16 | 6/16 | 8/16 | 10/16 | 12/16 |
| $D_N$ | 0.40 | 0.75 | 1.05 | 1.25 | 1.40 | 1.50 |
| difference data | 0.050 | 0.044 | 0.038 | 0.025 | 0.019 | 0.013 |
| change | decrease | decrease | decrease | decrease | decrease | decrease |

In the foregoing step S30, when the point of inflection exists in the output characteristics, the program proceeds to the step S31. In the step S31, the developing conditions are adjusted by the first correcting means such that the point of inflection does not exist. On the other hand, when no point of inflection exists in the output characteristics, the program proceeds to the step S33.

In adjusting the developing conditions by the first correcting means such that the point of inflection does not exist in the foregoing step S31, at least one of the frequency and the amplitude value of an AC voltage in a developing bias voltage to be applied to the developer carrying member 41 from the power supply 44 is changed in the present embodiment.

Figure 9:
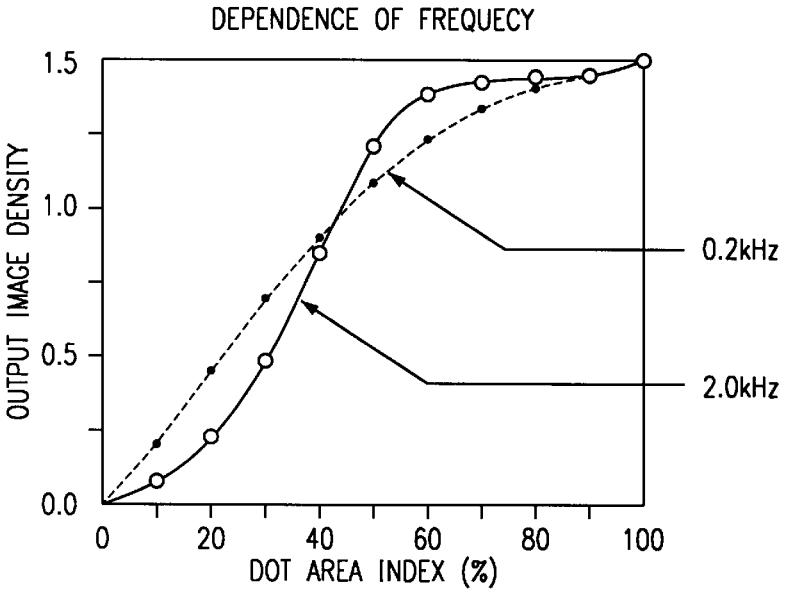
FIG. 9 is a diagram showing a state where the relationship between a dot area index and an output image density changes in a case where the frequency of an AC voltage in a developing bias voltage to be applied to a developer carrying member in a developing device is changed in the image forming apparatus according to the first embodiment.
Figure 10:
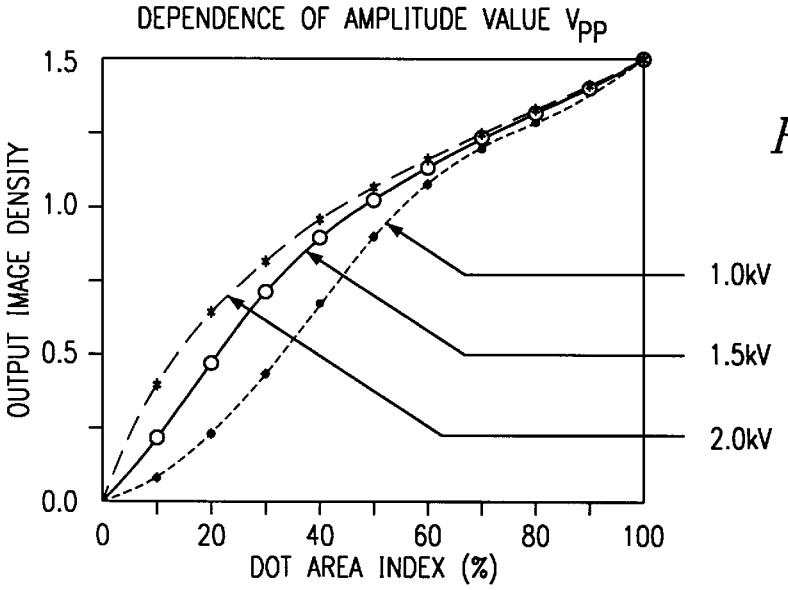
FIG. 10 is a diagram showing a state where the relationship between a dot area index and an output image density changes in a case where the amplitude value of an AC voltage in a developing bias voltage to be applied to the developer carrying member in the developing device in the image forming apparatus according to the first embodiment.

The change in the output characteristics dependent on the change in the frequency of the AC voltage is examined. Even if a point of inflection exists in the output characteristics at a frequency of 2 kHz, as shown in FIG. 9, for example, no point of inflection exists in the output characteristics in a case where the frequency is decreased to 0.2 kHz. On the other hand, the change in the output characteristics dependent on the change in the amplitude value of the AC voltage is examined. Even if a point of inflection exists in the output characteristics at an amplitude value of 1.0 kV, as shown in FIG. 10, for example, no point of inflection exists in the output characteristics in a case where the amplitude value is increased to 1.5 kV or 2.0 kV.

When the respective changes in the output characteristics in a case where the frequency and the amplitude value of the AC voltage are changed are compared, it is preferable that the frequency is adjusted in order to correct the overall S shape. On the other hand, it is preferable that the amplitude value is adjusted in order to correct a shape having a point of inflection in a low density portion.

When there exists such a point of inflection as to change from its increase to its decrease, the frequency may be corrected in the direction in which it decreases, and the amplitude value may be corrected in the direction in which it increases. On the other hand, when there exists such a point of inflection as to change from its decrease to its increase, the frequency may be corrected in the direction in which it increases, and the amplitude value may be corrected in the direction in which it decreases.

In thus changing the frequency and the amplitude value of the AC voltage, it is also possible to respectively change the frequency and the amplitude value of the AC voltage by predetermined values previously stored in the fourth ROM 92*d* or to adjust the frequency and the amplitude value of the AC voltage while referring to a table previously stored in the fourth ROM 92*d* on the basis of the difference data detected in the above-mentioned manner.

After the developing conditions are thus adjusted such that the point of inflection does not exist in the step S31, the program is returned to the foregoing step S23 upon setting the flag to "1" in the subsequent step S32. A routine in the foregoing steps S23 to S32 is repeated until no point of inflection exists in the output characteristics.

When the point of inflection does not exist in the output characteristics, the program proceeds to the step S33, as in a case where there is no point of inflection in the output characteristics. In the step S33, it is judged whether or not the flag is "0". A case where the flag is "0" is a case where no point of inflection exists in the output characteristics, and the difference between the densities of the output images is smaller than the predetermined value, so that the program is returned to the main routine. This point will be described later.

On the other hand, if the flag is not "0", the difference between the densities of the output images is adjusted, so that the program proceeds to the step S42, to control the difference between the densities of the output images.

In the early stages of the subroutine for adjusting developing conditions, the flag is initialized to "1" in the foregoing step S21, so that the program always proceeds to the step S42. When the developing conditions are adjusted such that the point of inflection does not exist in the step S31 as described above, the flag is set to "1" in the step S32. After the developing conditions are adjusted such that the point of inflection does not exist, therefore, the program always proceeds to the step S42.

The number of patterns Mmax of image data in the resolution data, which are the same in dot area percentage and differ in resolution, stored in the third ROM 92*c* is read out in the step S42.

A counter M is then set to zero in the step S43, image data with the M-th pattern corresponding to the counter M is read out from the third ROM 92*c* in the step S44, and the image data with the M-th pattern read out is exposed to the image carrying member 1 by the laser light source 3 to form an electrostatic latent image corresponding to the image data with the M-th pattern in the subsequent step S45.

The electrostatic latent image with the M-th pattern formed in the image carrying member 1 is developed in the step S46, and an image density $D_M$ of an image with the M-th pattern obtained by thus developing the electrostatic latent image formed in the image carrying member 1 is measured by the optical density sensor 5 in the subsequent step S47. After the image density $D_M$ of the image with the M-th pattern is thus measured by the optical density sensor 5, the image with the M-th pattern is removed by the cleaning device 8 without being transferred on the paper sheet 7.

The value of the counter M is then incremented by one in the step S48, and it is judged in the step S49 whether or not the value of the counter M after the increment reaches the number of patterns Mmax. When the value of the counter M does not reach the number of patterns Mmax, the program is returned to the foregoing step S44. A routine in the foregoing steps S44 to S49 is repeated until the value of the counter M reaches the number of patterns Mmax.

When the value of the counter M reaches the number of patterns Mmax, the program proceeds to the subsequent step S50. In the step S50, it is judged whether or not the difference between the image densities $D_M$ is not more than a predetermined value.

Figure 11:
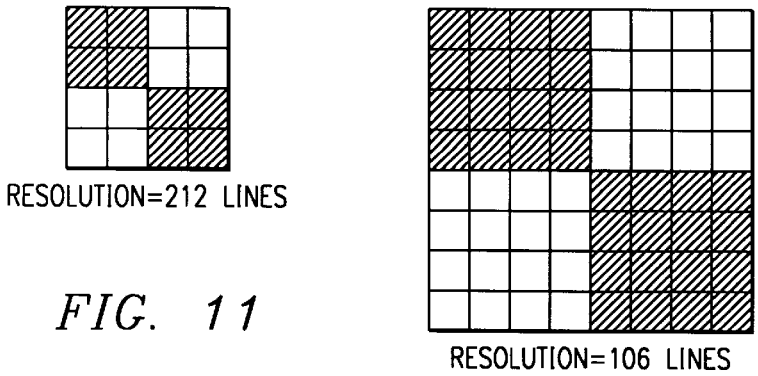
FIG. 11 is a diagram showing image data, which have a dot area index of 50% and differ in resolution, used for detecting the difference between output image densities in the image forming apparatus according to the first embodiment.

In the image forming apparatus according to the present embodiment, examples of image data in the resolution data include two image data having a dot area index of 50% at which the difference between the densities of output images obtained by developing an image having a high resolution and an image having a low resolution is liable to occur, as shown in FIG. 11, and corresponding to a resolution of 212 lines in a case where tone reproduction is made using four dots by four dots as one pixel and a resolution of 106 lines in a case where tone reproduction is made using eight dots by eight dots as one pixel.

It is judged in the foregoing step S50 whether or not the difference between the image densities $D_M$ of images obtained by developing the above-mentioned two image data is not more than a predetermined value. The program proceeds to the step S51 unless the difference between the image densities $D_M$ is not more than the predetermined value, while proceeding to the step S53 if the difference between the image densities $D_M$ is not more than the predetermined value.

In the foregoing step S51, the developing conditions are adjusted by the second correcting means such that the difference between the image densities $D_M$ decreases.

In adjusting the developing conditions by the second correcting means to decrease the difference between the image densities $D_M$ in the foregoing step S51, at least one of the value of a DC voltage in the developing bias voltage to be applied to the developer carrying member 41 from the power supply 44 and the duty ratio in an AC voltage is changed.

Figure 12:
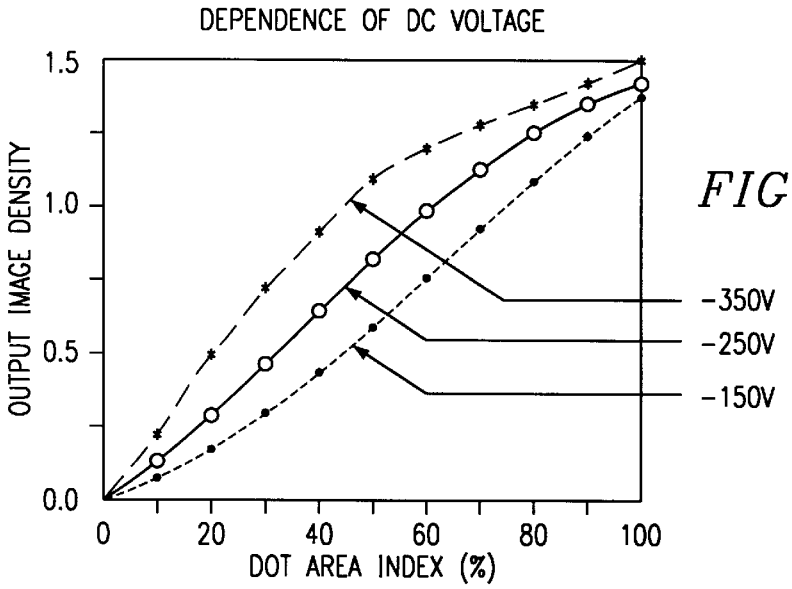
FIG. 12 is a diagram showing a state where the relationship between a dot area index and an output image density changes in a case where the value of a DC voltage in a developing bias voltage to be applied to the developer carrying member in the developing device in the image forming apparatus according to the first embodiment.

When the relationship between the change in the value of the DC voltage and the change in the image density $D_M$ in the image having a high resolution is examined, a state where the image density $D_M$ increases as the dot area index increases is changed by changing the value of the DC voltage, as shown in FIG. 12, for example, and the image density $D_M$ linearly increases as the dot area index increases when the value of the DC voltage is set between −250 V and −150 V, as compared with a case where it is set to −350 V.

Figure 13:
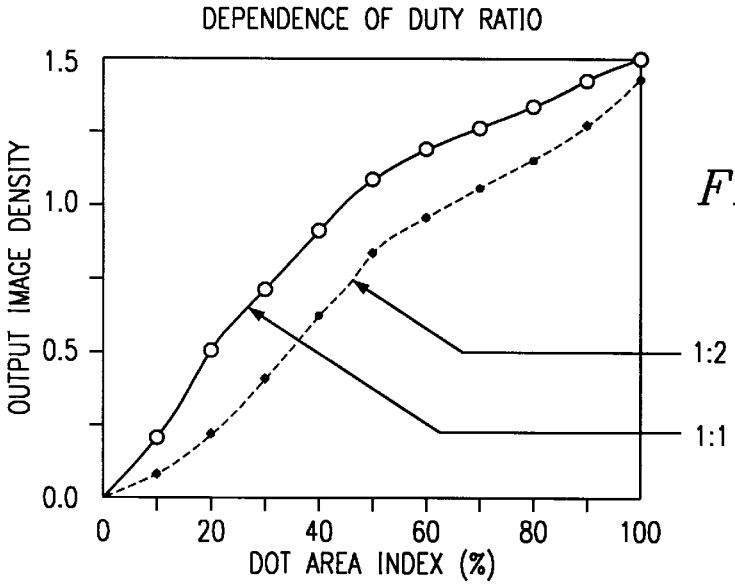
FIG. 13 is a diagram showing a state where the relationship between a dot area index and an output image density changes in a case where the duty ratio of an AC voltage in a developing bias voltage to be applied to the developer carrying member in the developing device in the image forming apparatus according to the first embodiment.

When the relationship between the change in the duty ratio in the AC voltage and the change in the image density $D_M$ is examined, the image density $D_M$ linearly increases as the dot area index increases when an AC voltage having a duty ratio of 1 to 2 is used, as compared with a case where an AC voltage having a duty ratio of 1 to 1 is used, as shown in FIG. 13, for example, so that the difference between the image density $D_M$ in the image having a high resolution and the image density $D_M$ in the image having a low resolution decreases.

In thus changing the value of the DC voltage and the duty ratio in the AC voltage, the respective values are changed by predetermined values previously stored in the fourth ROM 92*d,* or are changed while referring to a table previously stored in the fourth ROM 92*d* on the basis of the difference between the image densities $D_M$ detected in the above-mentioned manner.

After the developing conditions are adjusted such that the difference between the image densities $D_M$ decreases in the foregoing step S51, the program is returned to the foregoing step S43 upon setting the flag to "0" in the subsequent step S52. A routine in the foregoing steps S43 to S52 is repeated until the difference between the image densities $D_M$ attains not more than the predetermined value.

When the difference between the image densities $D_M$ attains not more than the predetermined value, the program proceeds to the step S53, as in a case where the difference between the image densities $D_M$ is not more than the predetermined value. In the step S53, it is judged whether or not the flag is "1".

A case where the flag is "1" is a case where no point of inflection exists in the output characteristics by the first correcting means, and the difference between the image densities $D_M$ is smaller than the predetermined value without performing the operation in the foregoing step S51. That is, in this case, there is no point of inflection in the output characteristics, and the difference between the image densities $D_M$ is smaller than the predetermined value, so that the program is returned to the main routine.

On the other hand, a case where the flat is not "1" is a case where the operation in the step S51 for decreasing the difference between the image densities $D_M$ is performed, so that the flag is "0" in the step S52. In this case, a point of inflection may occur in the output characteristics by adjusting the developing conditions by the second correcting means in the foregoing step S51. Therefore, the program is returned to the foregoing step S22. Operations in the foregoing steps S22 to S29 are performed, and it is judged in the foregoing step S30 whether or not there is a point of inflection in the output characteristics.

When it is judged in the step S30 that there is no point of inflection in the output characteristics, the program proceeds to the step S33. In the step S33, it is judged whether or not the flag is "0". In this case, the flag is "0" in the step S52 as described above, so that the program is returned to the main routine.

On the other hand, when it is judged in the step S30 that there is a point of inflection in the output characteristics, the program proceeds to the step S31. In the step S31, the above-mentioned operations are repeatedly performed until the point of inflection does not exist in the output characteristics, and the difference between the image densities $D_M$ is smaller than the predetermined value, after which the program is returned to the main routine.

Figure 1:
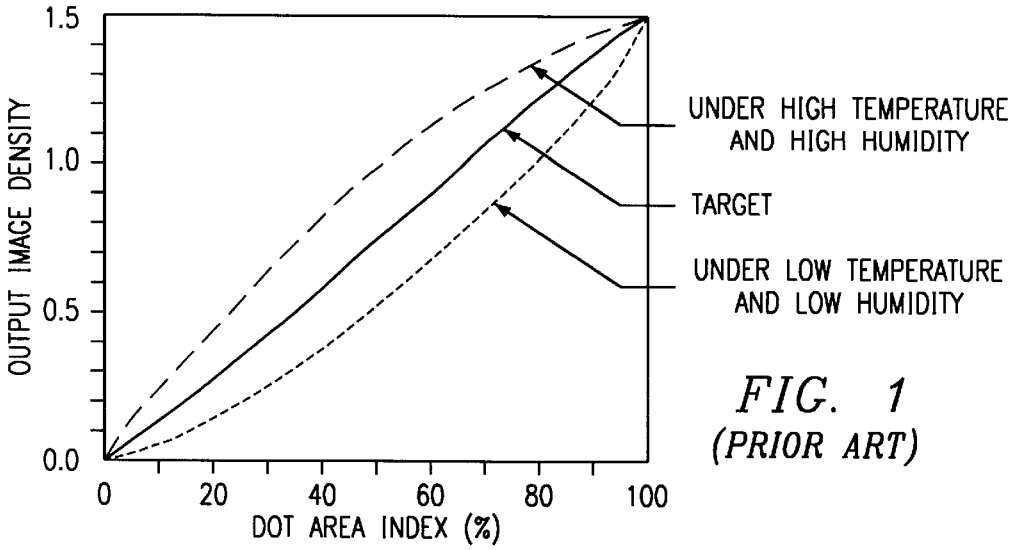
FIG. 1 (PRIOR ART)
FIG. 1 is a diagram showing a state where the relationship between a dot area index and an output image density changes depending on changes in environment in an image forming apparatus for making tone reproduction using a variable area toning method.
Figure 2:
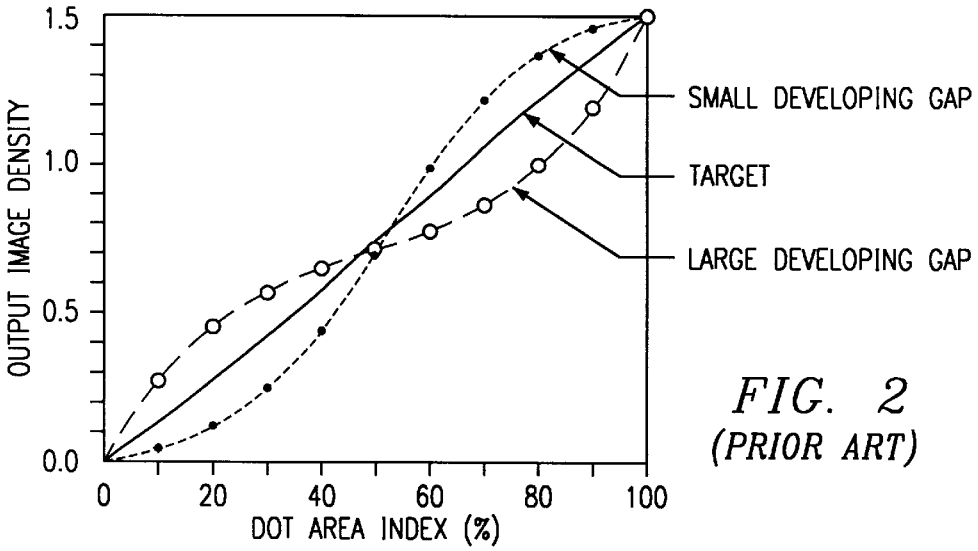
FIG. 2 (PRIOR ART)
FIG. 2 is a diagram showing a state where the relationship between a dot area index and an output image density changes depending on the variation in spacing between a developer carrying member and an image carrying member (a developing gap) in an image forming apparatus for making tone reproduction using a variable area toning method.
Figure 3:
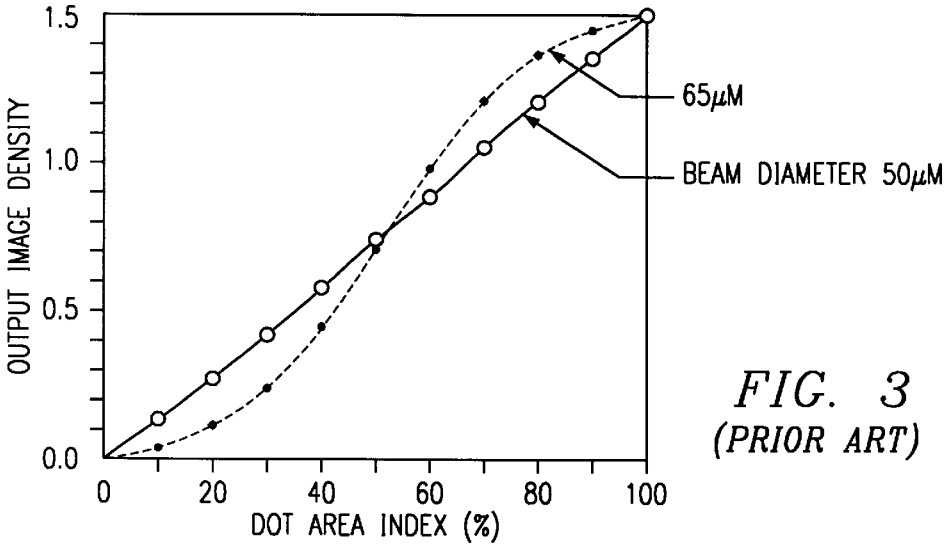
FIG. 3 (PRIOR ART)
FIG. 3 is a diagram showing a state where the relationship between a dot area index and an output image density changes depending on the variation in the beam diameter of a laser beam in an image forming apparatus for making tone reproduction using a variable area toning.

Although in the image forming apparatus according to the present embodiment, the image density of the image formed in the image carrying member 1 is measured by the optical density sensor 5, as shown in FIG. 1, the position or the like where the image density is measured is not limited. For example, in an image forming apparatus for transferring an image formed on the surface of the image carrying member 1 to an intermediate transfer member (not shown) and then transferring the image on the paper sheet 7 from the intermediate transfer member, the image density of the image transferred on the intermediate transfer member may be detected by the optical density sensor 5.

One example of a printing operation in the image forming apparatus according to the present embodiment will be described on the basis of a flow chart of FIG. 14.

When the printing operation is started, a pattern for printing is read out from the second ROM 92*b* in the step S61.

In the step S62, image data sent from the host computer is binary-coded using the pattern for printing. In the subsequent step S63, other operations relating to the printing operation are performed, after which the program is returned to the main routine.

As a result of an elapse of a long time period from the last adjustment of the developing conditions, the most suitable developing conditions may be changed. In such a case, therefore, it is preferable that a printing operation conforming to a flow chart shown in FIG. 15 is performed.

Figure 15:
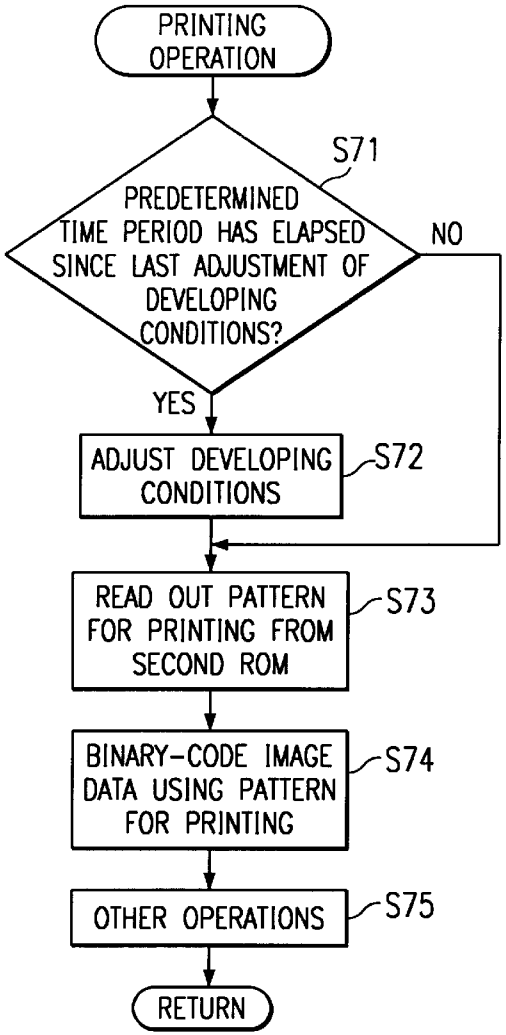
FIG. 15 is a diagram showing a subroutine in a modified example of a printing operation in the image forming apparatus according to the first embodiment.

The printing operation will be specifically described on the basis of the flow chart shown in FIG. 15.

When the printing operation is first started, it is judged in the step S71 whether or not a predetermined time period has elapsed since the last adjustment of the developing conditions was made. When the predetermined time period has elapsed, the program proceeds to the step S72. On the other hand, when the predetermined time period has not elapsed, the program proceeds to the step S73 after the step S72 is skipped. In the foregoing step S72, the developing conditions are adjusted in accordance with the subroutine for adjusting developing conditions shown in FIG. 7, after which the program proceeds to the step S73.

Figure 14:
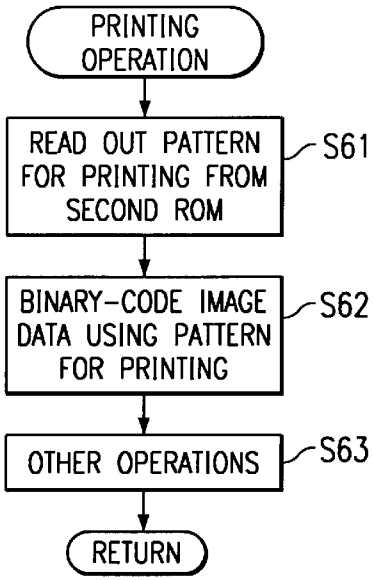
FIG. 14 is a diagram showing a subroutine for a printing operation in the image forming apparatus according to the first embodiment.

Thereafter, as in the above-mentioned flow chart shown in FIG. 14, the pattern for printing is read out from the second ROM 92*b* in the foregoing step S73, the image data sent from the host computer is binary-coded using the pattern for printing in the subsequent step S74, and the other operations relating to the printing operation are performed in the step S75, after which the program is returned to the main routine.

Even if environmental conditions, for example, change between the printing operation and the subsequent printing operation, the subsequent printing is done by suitably adjusting the developing conditions, so that it is possible to make density adjustment with higher precision.

In a case where the predetermined time period has elapsed since the last adjustment of the developing conditions was made, as described above, it is considered that the environmental conditions mainly vary, and the developing gap hardly varies. In adjusting the developing conditions in the foregoing step S72, therefore, only the operations in the steps S42 to S51 in the subroutine for adjusting developing conditions shown in FIG. 7 may be performed to carry out such control that the difference between the image densities $D_M$ is not more than the predetermined value.

(Embodiment 2)

Figure 16:
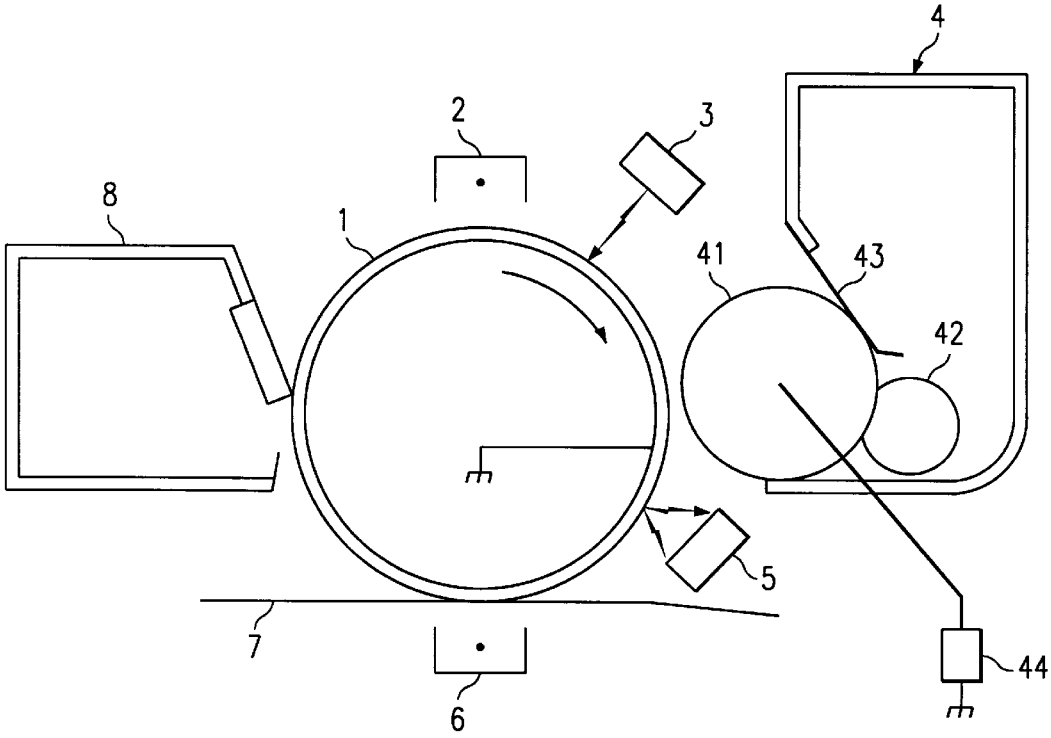
FIG. 16 is a schematic cross-sectional view of an image forming apparatus according to a second embodiment of the present invention.

An image forming apparatus according to the present embodiment is also constructed, similar to the above-mentioned image forming apparatus according to the embodiment 1, as shown in FIG. 16, so that the description of the same components as those in the image forming apparatus according to the embodiment 1 is not repeated.

In the image forming apparatus according to the present embodiment 2, in developing an electrostatic latent image formed on the surface of an image carrying member 1 by a developing device 4, a developer carrying member 41 in a roller shape is provided so as to be brought into contact with the image carrying member 1, and an AC voltage on which a DC voltage is superimposed is exerted on the developer carrying member 41 as a developing bias voltage from a power supply 44 to perform development, thereby forming a toner image corresponding to the electrostatic latent image on the surface of the image carrying member 1.

Consider a case where the developer carrying member 41 is provided so as to be brought into contact with the image carrying member 1 to perform development as in the image forming apparatus according to the embodiment 2. In this case, even in adjusting the developing conditions, the developing conditions are adjusted in accordance with the above-mentioned subroutine shown in FIG. 7.

In the image forming apparatus according to the embodiment 2, the amplitude value of an AC voltage in a developing bias voltage to be applied to the developer carrying member 41 from the power supply 44 is adjusted, when it is judged in the foregoing step S30 that a point of inflection exists in output characteristics, the developing conditions by first correcting means such that the point of inflection does not exist in the subroutine for adjusting developing conditions shown in FIG. 7.

Figure 17:
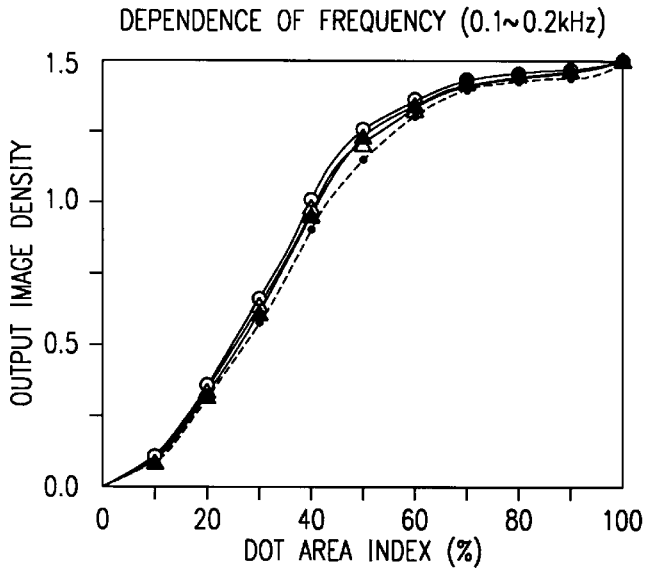
FIG. 17 is a diagram showing the effect of changes in the frequency of an AC voltage in a developing bias voltage to be applied to a developer carrying member in a developing device on the relationship between a dot area index and an output image density in the image forming apparatus according to the second embodiment.
Figure 18:
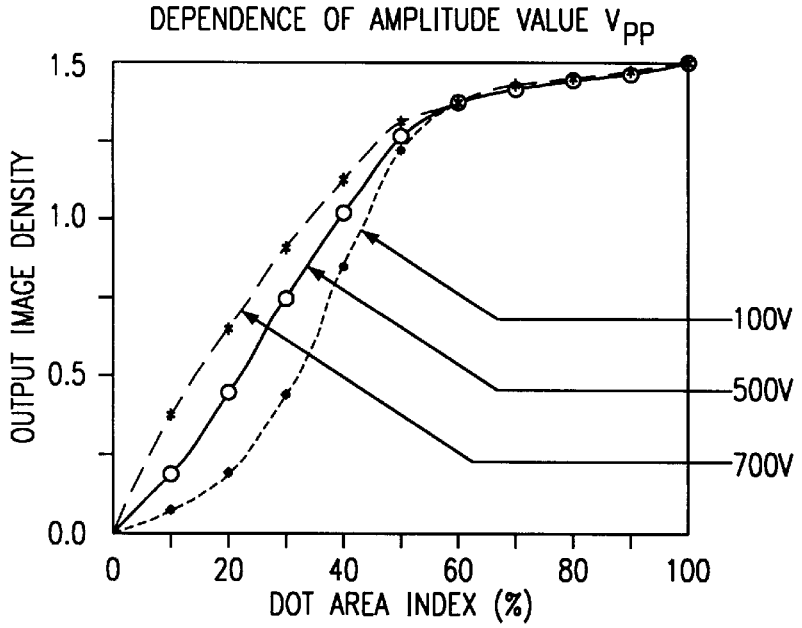
FIG. 18 is a diagram showing a state where the relationship between a dot area index and an output image density changes in a case where the amplitude value of an AC voltage in a developing bias voltage to be applied to the developer carrying member in the developing device is changed in the image forming apparatus according to the second embodiment.

When the developer carrying member 41 is brought into contact with the image carrying member 1 to perform development as in the image forming apparatus according to the embodiment 2, it is impossible that the above-mentioned point of inflection does not exist even if the frequency of the AC voltage in the developing bias voltage to be applied to the developer carrying member 41 from the power supply 44 is changed in the range of 0.1 to 2.0 kHz, as shown in FIG. 17, as in the image forming apparatus according to the embodiment 1. On the other hand, it is possible that the point of inflection does not exist when the amplitude value of the AC voltage in the developing bias voltage to be applied to the developer carrying member 41 from the power supply 44 is changed, as shown in FIG. 18.

In the image forming apparatus according to the present embodiment 2, when it is judged in the step S50 in the above-mentioned subroutine for adjusting developing conditions shown in FIG. 7 that the difference between image densities $D_M$ does not attain not more than a predetermined value, the value of a DC voltage in the developing bias voltage to be applied to the developer carrying member 41 from the power supply 44 is changed in adjusting the developing conditions by the second correcting means to decrease the difference between the image densities $D_M$ in the subsequent step S51.

Figure 19:
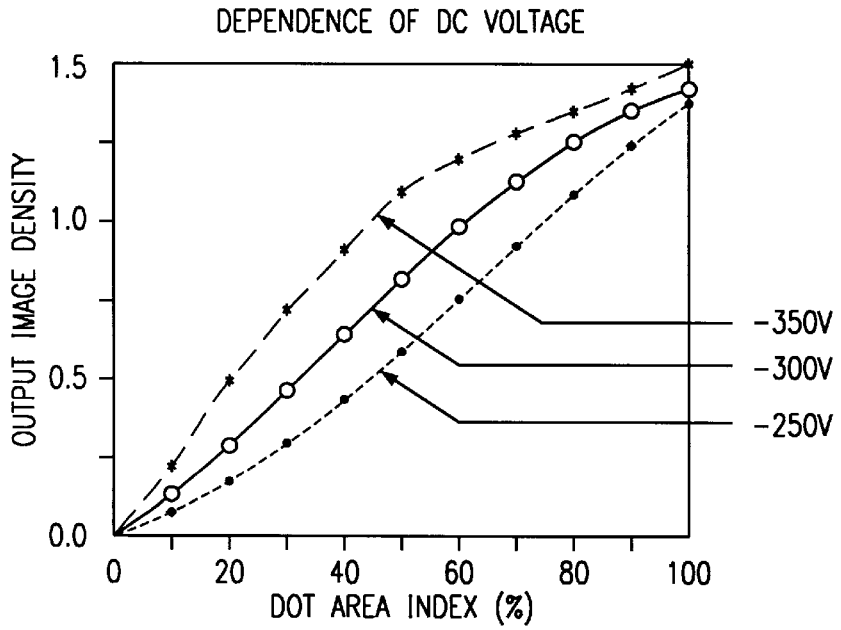
FIG. 19 is a diagram showing a state where the relationship between a dot area index and an output image density changes in a case where the value of a DC voltage in a developing bias voltage to be applied to the developer carrying member in the developing device is changed in the image forming apparatus according to the second embodiment.

When the developer carrying member 41 is brought into contact with the image carrying member 1 to perform development as in the image forming apparatus according to the embodiment 2, it is impossible to decrease the difference between the image densities $D_M$ even if the duty ratio of the AC voltage in the developing bias voltage to be applied to the developer carrying member 41 from the power supply 44 is changed, as in the case of the image forming apparatus according to the embodiment 1. On the other hand, when the value of the DC voltage in the developing bias voltage to be applied to the developer carrying member 41 from the power supply 44 is changed, as shown in FIG. 19, the image density $D_M$ linearly increases as a dot area index increases, so that the difference between an image density $D_M$ in an image having a high resolution and an image density $D_M$ in an image having a low resolution decreases.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. An image forming apparatus comprising:

an image carrying member on which a latent image is formed;

developing means for developing the latent image on the image carrying member;

first latent image forming means for forming a plurality of latent images having different dot area indexes on the image carrying member;

first detecting means for detecting image densities of images obtained by developing the latent images formed by the first latent image forming means;

first correcting means for correcting developing conditions in the developing means depending on the image densities detected by the first detecting means;

second latent image forming means for forming a plurality of latent images having different resolutions on the image carrying member;

second detecting means for detecting image densities of images obtained by developing the latent images formed by the second latent image forming means; and second correcting means for correcting the developing conditions in the developing means depending on the image densities detected by the second detecting means.

2. The image forming apparatus in accordance with claim 1, further comprising first determining means for determining whether or not there is a point of inflection in a relationship between a dot area index and a corresponding image density detected by the first detecting means, wherein said first correcting means corrects the developing conditions in the developing means when there is a point of inflection.

3. The image forming apparatus in accordance with claim 2, further comprising second determining means for determining whether or not a difference between the image densities detected by the second detecting means is larger than a predetermined value, wherein said second correcting means corrects the developing conditions in the developing means when the density difference is larger than the predetermined value.

4. The image forming apparatus in accordance with claim 3, wherein said developing means has a developer carrying member for holding the developer, the developer carrying member being provided with predetermined spacing from the image carrying member.

5. The image forming apparatus in accordance with claim 4, further comprising applying means for applying an AC voltage on which a DC voltage is superimposed between the image carrying member and the developer carrying member, wherein the first correcting means changes the frequency of the AC voltage when there is a point of inflection.

6. The image forming apparatus in accordance with claim 4, further comprising applying means for applying an AC voltage on which a DC voltage is superimposed between the image carrying member and the developer carrying member, wherein the first correcting means changes the amplitude of the AC voltage when there is a point of inflection.

7. The image forming apparatus in accordance with claim 4, further comprising applying means for applying an AC voltage on which a DC voltage is superimposed between the image carrying member and the developer carrying member, wherein the second correcting means changes the duty ratio of the AC voltage when the density difference is larger than the predetermined value.

8. The image forming apparatus in accordance with claim 4, further comprising applying means for applying an AC voltage on which a DC voltage is superimposed between the image carrying member and the developer carrying member, wherein the second correcting means changes the value of the DC voltage when the density difference is larger than the predetermined value.

9. The image forming apparatus in accordance with claim 3, wherein said developing means has a developer carrying member for holding the developer, the developer carrying member being provided in contact with the image carrying member.

10. The image forming apparatus in accordance with claim 9, further comprising applying means for applying an AC voltage on which a DC voltage is superimposed between the image carrying member and the developer carrying member, wherein the first correcting means changes the amplitude of the AC voltage when there is a point of inflection.

11. The image forming apparatus in accordance with claim 9, further comprising applying means for applying an AC voltage on which a DC voltage is superimposed between the image carrying member and the developer carrying member, wherein the second correcting means changes the value of the DC voltage when the density difference is larger than the predetermined value.

12. The image forming apparatus in accordance with claim 3, wherein the second latent image forming means, the second detecting means, and the second correcting means are adapted to repeat their respective operations until the density difference is smaller than the predetermined value.

13. The image forming apparatus in accordance with claim 2, wherein the first latent image forming means, the first detecting means, and the first correcting means are adapted to repeat their respective operations until the point of inflection does not exist.

14. An image forming apparatus comprising:

an image carrying member on which a latent image is formed;

developing means for developing the latent image on the image carrying member;

first latent image forming means for forming a plurality of latent images having different dot area indexes on the image carrying member;

first detecting means for detecting the image densities of images obtained by developing the latent images formed by the first latent image forming means;

first determining means for determining whether or not there is a point of inflection in a relationship between a dot area index and a corresponding image density detected by the first detecting means;

first correcting means for correcting developing conditions in the developing means when there is a point of inflection;

second latent image forming means for forming a plurality of latent images having different resolutions on the image carrying member;

second detecting means for detecting the image densities of images obtained by developing the latent images formed by the second latent image forming means;

second determining means for determining whether or not the difference between the image densities detected by the second detecting means is larger than a predetermined value; and second correcting means for correcting the developing conditions in the developing means when the density difference is larger than the predetermined value.

15. The image forming apparatus in accordance with claim 14, wherein the first latent image forming means, the first detecting means, and the first correcting means are adapted to repeat their respective operations until the point of inflection does not exist.

16. The image forming apparatus in accordance with claim 14, wherein the second latent image forming means, the second detecting means, and the second correcting means are adapted to repeat their respective operations when the density difference is smaller than the predetermined value.

17. A method of controlling an image forming apparatus, the method comprising the steps of:

(a) forming a plurality of images having different dot area indexes;

(b) detecting the image densities of the images having different dot area indexes;

(c) determining whether or not there is a point of inflection in the relationship between a dot area index and a corresponding image density detected;

(d) correcting image forming conditions when there is a point of inflection;

(e) forming a plurality of images having different resolutions;

(f) detecting the image densities of the images having different resolutions;

(g) determining whether or not the difference between the densities of the images is larger than a predetermined value; and (h) correcting the image forming conditions when the density difference is larger than the predetermined value.

18. The method in accordance with claim 17, wherein the steps (a) to (d) are repeated until the point of inflection does not exist.

19. The method in accordance with claim 17, wherein the steps (e) to (h) are repeated until the density difference is smaller than the predetermined value.

* * * * *